United States Patent [19]

Field et al.

[11] Patent Number: 4,794,782

[45] Date of Patent: Jan. 3, 1989

[54] PIVOTING HOIST

[76] Inventors: Carl R. Field, 1013 SE. Peterson; Pichai Saichaie, 1717 NW. 9th St., both of Ankeny, Iowa 50021

[21] Appl. No.: 83,220

[22] Filed: Aug. 10, 1987

[51] Int. Cl.[4] ..... B21D 1/12

[52] U.S. Cl. ..... 72/457

[58] Field of Search ..... 72/705, 457; 187/8.41, 187/8.43, 8.45, 8.54; 254/8 R, 8 B, 8 C, 45

[56] References Cited

U.S. PATENT DOCUMENTS

| | | | |
|---|---|---|---|
| 4,313,335 | 2/1982 | Eck . | |
| 4,353,241 | 10/1982 | Field . | |
| 4,379,545 | 4/1983 | Gray et al. | 254/8 B |
| 4,546,638 | 10/1985 | Field . | |
| 4,574,614 | 3/1986 | Field . | |

OTHER PUBLICATIONS

"Practi-Pull Mark II" by Guy Chart, Batavia, N.Y., 14020 Apr. 1978, copy in 72/705.

Advertisement, Automotive Body Repair News, Jun. 1987, p. 29.

Kansas Jack Magna-Rack Operations Manual, Kansas Jack, 1101 West First, McPherson, Kansas, pp. 1, 18-19.

Kansas Jack World Rack Operations Manual, Kansas Jack, 1101 West First, McPherson, Kansas, pp. 1, 26.

Brochure-Jack World Rack 2000, "Introducing the Ultimate Rack", Kansas Jack, 1101 First, McPherson, Kansas.

*Primary Examiner*—Lowell A. Larson

*Attorney, Agent, or Firm*—Henderson & Sturm

[57] ABSTRACT

An apparatus including a vehicle support, for receivably supporting the wheels of a vehicle which has pulling towers attached to the vehicle support for pulling on a part of a vehicle disposed on the vehicle support. An arm is pivotally attached to the tower at one end thereof and has an engagement attachment disposed on the other end of the arm for abutment with the other side of the vehicle. An intermediate portion of the arm, between the ends thereof, is operably attached to the tower for permitting the tower apparatus to selectively pivot the arm up and down and thereby cause the engagement attachment and the vehicle in engagement therewith to move up and down accordingly.

5 Claims, 1 Drawing Sheet

PIVOTING HOIST

TECHNICAL FIELD

The present invention relates generally to a hoist for vehicles and more particularly to a hoist for use in combination with vehicle repair racks of a type having towers thereon for pulling on vehicle parts.

BACKGROUND ART

Machines for repairing and straightening vehicle bodies such as that shown in U.S. Pat. No. 4,574,614, which is incorporated herein by reference, are in common usage today. Machines or racks of this type are particularly useful, if not necessary, for straightening unibody cars. For example, in FIGS. 2 and 10 of U.S. Pat. No. 4,574,614, tie down units (252) are shown which are bolted to a pinch welt (254) below the rocker panel of a unibody car. Since these unibody cars have no frame, it is necessary to straighten or repair teem by use of such tie down units.

In order to attach tie down units, such as units (252) as shown U.S. Pat. No. 4,574,614, one side of the vehicle must first be lifted, the tie down clamps inserted thereunder, and the vehicle then lowered down so that the weight of the vehicle is supported on the tie down brackets (252) instead of on the wheels of the vehicle.

The aforementioned installation of tie down brackets for unibody cars has heretofore been accomplished by the use of jacks, such as hydraulic or mechanical jacks. As in the use of most jacks, they are time consuming to use, and because they can slip out from under the car, they are not altogether safe. Since the use of a jack is time-consuming, inconvenient and dangerous if it slips out, it would be desirable to provide another way to lift first one side of the vehicle and then the other for the purpose of attaching tie down brackets. It is also necessary from time to time to lift up one side of the car or the other for providing access for other reconstruction purposes. This is true even for vehicles which are not of a unibody construction.

DISCLOSURE OF THE INVENTION

The present invention relates generally to an apparatus including a vehicle support for receivably supporting the wheels of a vehicle which has pulling towers attached to the vehicle support for pulling on a part of a vehicle disposed on the vehicle support. An arm is pivotally attached to the tower at one end thereof and has an engagement attachment disposed on the other end of the arm for abutment with the other side of the vehicle. An intermediate portion of the arm, between the ends thereof, is operably attached to the tower for permitting the tower apparatus to selectively pivot the arm up or down and thereby cause the engagement attachment and the vehicle in engagement therewith to move up and down accordingly.

An object of the present invention is to provide an improved hoist for use in combination with racks used to straighten the bodies of vehicles.

Another object of the present invention is to utilize the power equipment already present on vehicle repair racks and use such power equipment to lift the side of a vehicle.

Another object of the present invention is to eliminate the need for separate jacks for lifting the side of a vehicle up off the wheels, for example, to attach unibody clamps thereto.

A still further object of the present invention is to provide a hoist of the aforementioned type which is economical to produce, simple to use and which is safe and dependable.

Other objects, advantages, and novel features of the present invention will become apparent from the following detailed description of the invention when considered in conjunction with the accompanying drawings.

BEST MODES FOR CARRYING OUT THE INVENTION

Figures 1, 2, 3, 4:
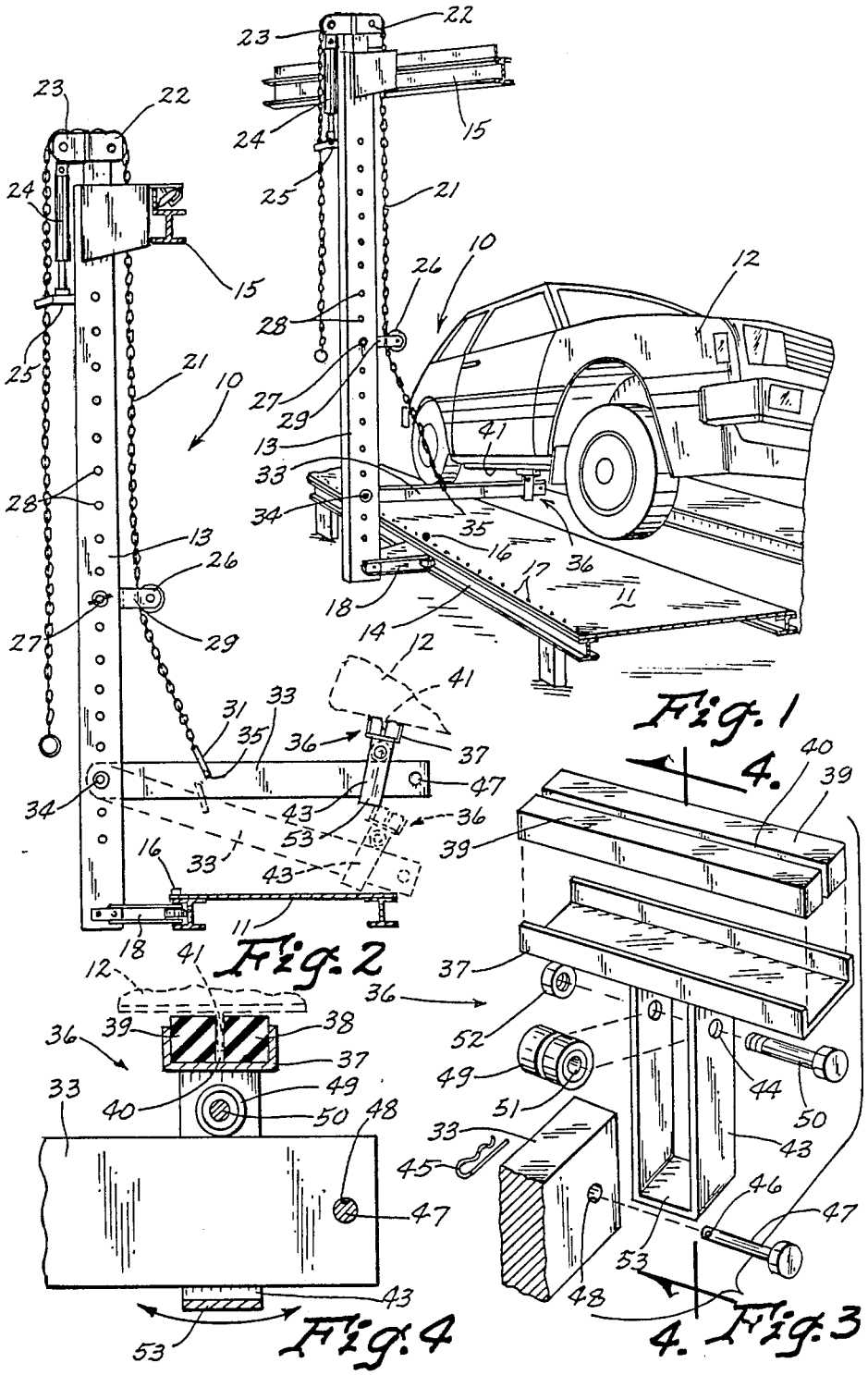
FIG. 1 is a perspective view of the present invention shown lifting up one side of an automobile.
FIG. 2 is a front elevational view of the present invention in a position shown lifting the automobile up so that one side is above another.
FIG. 3 is an exploded perspective view of the portion of the present invention which engages the vehicle and which slides along a pivoting arm.
FIG. 4 is a enlarged partial cross sectional view taken along 4—4 of FIG. 1.

Referring now to the drawings wherein like reference numerals designate identical or corresponding parts throughout the several views, FIG. 1 shows the present invention (10) attached to a vehicle repairing and straightening rack of the type shown in U.S. Pat. No. 4,574,614 and having a vehicle wheel supporting member (11) onto which a vehicle (12) can be driven or pulled. Towers (13) can be rolled along tracks (14 and 15) to be placed in a proper position whereby they can be held in place by pins (16) extending through holes (17) in the vehicle support (11) and through holes in member (18).

A chain (21) extends over top pulleys (22 and 23) and can be adjustably attached to the bottom of a hydraulic cylinder (24) by a connector (25). The other end of the chain (21) extends around a pulley (26), which can be held at a desired vertical location by extending a pin (27) through openings (28) in the tower (13) and through an opening (not shown) in bracket (29).

As is well known, the end (31) of the chain (21) can be connected to a vehicle part and pulled toward the tower (13) if desired. Since this structure, or equivalents thereof, are already found on most vehicle repair and straightening racks, the present invention relates to a hoist or jack attachment which utilizes these parts which are already are on the tower (13).

An arm (33) is pivotally attached at one end thereof to the tower (13) by use of a pin (34) extending through an opening in the arm (33) and through one of the lower openings (28) in the tower (13). The end (31) of the chain (21) is attached by a pin (35) which extends through one of the links of the chain (21) and through a hole in the arm (33).

Referring to FIG. 2, it is noted that an engagement attachment (36) is comprised of a U-shaped channel (37) having a pair of rubber blocks (38) and (39) vulcanized thereto and having a space (40) extending therebetween for receiving a flange (41) which is present on all unibody vehicles.

A U-shaped slide member (43) is welded to the bottom of the U-shaped channel (37) as is clearly shown in FIGS. 3 and 4. This U-shaped channel has aligned openings (44) extending therethrough for reasons which will be explained below.

In order to install the engagement apparatus (36) to the arm (33), a key (45) is removed from an opening (46) in pin (47) and the pin (47) is removed from the opening (48) in arm (33).

A bearing, such as roller bearings (49), are attached to the U-shaped member (43) by extending bolt (50) through aligned openings (44) and through an opening (51) in the bearings (49). A nut (52) holds the bolt (50) nd the bearing (49) in place. The U-shaped member (43) can then be slid over the top of the arm (33), for example, to the position shown in FIGS. 2 or 4. The pin (47) is then reinserted through the opening (48) and the cotter key (45) inserted through opening (46 to prevent the engagement attachment (36) from falling off the end of the arm (33).

In operation, a vehicle, such as automobile (12), would be positioned by driving it or pulling it onto the wheel supporting surface (11) at a time when the arm (33) is not attached to the tower (13). Once the vehicle (12) is in place with its wheels on the support surface (11), then the arm (33) can be pivotally attached to the tower (13) by extending the pin (34) therethrough and also through one of the openings (28) in the tower (13). A pin (35) can then be used to connect the chain (21) thereto as previously described.

The arm (33) would be attached at a time that the hydraulic cylinder (24) is shortened so that the arm (33) would be in the position shown in dashed lines in FIG. 2. By positioning the engagement attachment (36) by sliding it along the arm (33) and by lengthening the hydraulic cylinder (24), the engagement attachment (36) can be guided manually so that as the arm (33) pivots upwardly, the flange (41) can be guided into the slot (40) between the rubber blocks (38 and 39) of the engagement attachment (36). Once the flange (41) is in position, as shown in FIG. 4, then the hydraulic cylinder (24) is caused to be lengthened even more to the position shown in solid lines in FIG. 2, which causes the arm (33) to pivot to a somewhat vertical position and consequently causing the vehicle (12) to be tipped up such that the wheels on that side of the vehicle are lifted up off the support surface (11).

If, as in most cases, the purpose of lifting the vehicle (12) is to attach unibody tie down structures, then these structures would be supported on the support surface (11) and aligned with the flange (41). If the purpose of lifting the vehicle (12) is to work on a rocker panel or the like, then that could simply be done. But referring again to the situation where the purpose of the lifting is to attach tie down brackets, then such tie down brackets could be attached, once aligned, by merely shortening the cylinder (24) and lowering the vehicle((12) by pivoting the arm (33) downwardly until the flange (41) extends into the tie down brackets, at which time they could be secured in place. Tie down brackets would then be attached to the other side of the unibody car in a similar fashion.

It is important to note that the engagement bracket (36) can slide along arm (33) and can rock from side to side t some extent, as shown in FIG. 2. This rocking of engagement bracket (36) is limited to some extent by stops formed by the ends (53) of U-shaped slide member (43).

Accordingly, it will be appreciated that all of the aforementioned objects have been achieved by use of the preferred embodiment disclosed herein. Obviously, many modifications and variations of the present invention are possible in light of the above teachings. For example, many other configurations of towers and racks could be used in combination with the pivoting arm (33). It is therefore to be understood that, within the scope of the appended claims, the invention may be practiced otherwise than as specifically described.

We claim:

1. Apparatus comprising:

vehicle supporting means for receivingly supporting the wheels of a vehicle, said vehicle supporting means having a front end, a rear end, sides connected to and between said front and rear ends, a top, and a bottom;

tower means attached to said vehicle supporting means for pulling on a part of a vehicle disposed on said vehicle supporting means;

an arm;

pivoting means for pivotally attaching one end of said arm to said tower means;

engagement means operably disposed on the other end of said arm for abutment with the underside of a vehicle;

means operably attached to said tower means and to said arm between said one end and the other end thereof for pivoting said arm about the pivoting means; and, means for allowing said engagement means to slide in a laterally translatable manner with respect to said arm.

2. The apparatus of claim 1 including means for preventing said slide means from sliding off of the other end of said arm.

3. The apparatus of claim 1 including a roller bearing rotatably attached to said slide means and disposed under said engagement means and on top of said arm means for reducing friction when the engagement means slides along said arm.

4. The apparatus of claim 1 wherein said engagement means includes an elongated slit in the top thereof for receiving a rocker panel flange of a vehicle.

5. The apparatus of claim 4 wherein a top portion of said engagement means is constructed of a resilient material.

* * * * *